US011200780B2

(12) United States Patent
Nauman

(10) Patent No.: US 11,200,780 B2
(45) Date of Patent: Dec. 14, 2021

(54) GRAPHICAL USER INTERFACE FOR GAMING MACHINE

(71) Applicant: SG Gaming, Inc., Las Vegas, NV (US)

(72) Inventor: Jeffry L. Nauman, Yorkville, IL (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 17/066,639

(22) Filed: Oct. 9, 2020

(65) Prior Publication Data

US 2021/0110658 A1 Apr. 15, 2021

Related U.S. Application Data

(60) Provisional application No. 62/914,246, filed on Oct. 11, 2019.

(51) Int. Cl.

| | |
|---|---|
| ***G07F 17/00*** | (2006.01) |
| ***G07F 19/00*** | (2006.01) |
| ***G07F 17/32*** | (2006.01) |
| ***G07F 17/34*** | (2006.01) |

(52) U.S. Cl.

CPC ..... *G07F 17/3262* (2013.01); *G07F 17/3251* (2013.01); *G07F 17/3267* (2013.01); *G07F 17/34* (2013.01)

(58) Field of Classification Search

CPC ..... G07F 17/3251; G07F 17/3262; G07F 17/3267; G07F 17/34

See application file for complete search history.

(56) References Cited

U.S. PATENT DOCUMENTS

| | | | | |
|---|---|---|---|---|
| 6,015,346 | A * | 1/2000 | Bennett | G07F 17/32 463/20 |
| 6,102,798 | A * | 8/2000 | Bennett | G07F 17/34 463/16 |
| 6,174,235 | B1 * | 1/2001 | Walker | G07F 17/34 273/139 |
| 6,375,187 | B1 * | 4/2002 | Baerlocher | G07F 17/3244 273/143 R |
| 6,439,995 | B1 * | 8/2002 | Hughs-Baird | G07F 17/3244 273/138.1 |
| 6,632,141 | B2 * | 10/2003 | Webb | G07F 17/32 273/143 R |
| 2002/0025844 | A1 * | 2/2002 | Casey | G07F 17/32 463/16 |

(Continued)

*Primary Examiner* — Milap Shah

(57) ABSTRACT

A gaming system includes game-logic circuitry that is configured to direct the display of a graphical-user interface including selectable elements, each of which being associated with a respective outcome. The circuitry is configured to detect an initial selection of a first selectable elements and designate it as an active selection. The circuitry concurrently provides the abilities to elect to: (1) exchange the first selectable element with a another one of the selectable elements, the another one being designated—and the first losing the designation of—the active selection upon exchange, (2) eliminate one or more of the remaining selectable elements that are not the active selection by revealing a game outcome associated with the eliminated selectable element, the game outcome associated with the eliminated selectable being unavailable thereafter, and (3) reveal and accept the game outcome associated with the selectable element that is currently designated as the active selection.

20 Claims, 9 Drawing Sheets

(56) References Cited

U.S. PATENT DOCUMENTS

2002/0042294 A1* 4/2002 Pau ..... G07F 17/3262 463/16
2002/0198036 A1* 12/2002 Baerlocher ..... G07F 17/3267 463/16
2003/0036419 A1* 2/2003 Baerlocher ..... G07F 17/32 463/16
2003/0060253 A1* 3/2003 Kaminkow ..... G07F 17/32 463/16
2003/0060254 A1* 3/2003 Cuddy ..... G07F 17/3262 463/16
2003/0130025 A1* 7/2003 Gilmore ..... G07F 17/3202 463/16
2003/0153383 A1* 8/2003 Baerlocher ..... G07F 17/3202 463/25
2003/0162578 A1* 8/2003 Baerlocher ..... G07F 17/32 463/16
2003/0181233 A1* 9/2003 Baerlocher ..... G07F 17/32 463/16
2004/0082374 A1* 4/2004 Maya ..... G07F 17/3244 463/16
2004/0248639 A1* 12/2004 Slomiany ..... G07F 17/3262 463/16
2005/0020351 A1* 1/2005 Baerlocher ..... G07F 17/32 463/20
2005/0054416 A1* 3/2005 Hostetler ..... G07F 17/3262 463/16
2005/0159201 A1* 7/2005 Duhamel ..... G07F 17/3267 463/16
2005/0181855 A1* 8/2005 Englman ..... G07F 17/3295 463/16
2005/0187005 A1* 8/2005 Rose ..... G07F 17/3211 463/20
2006/0063582 A1* 3/2006 Baerlocher ..... G07F 17/32 463/16
2009/0286586 A1* 11/2009 Heymann ..... G07F 17/3244 463/20
2015/0356828 A1* 12/2015 Caputo ..... G07F 17/3246 463/25

* cited by examiner

GRAPHICAL USER INTERFACE FOR GAMING MACHINE

CROSS REFERENCE TO RELATED APPLICATIONS

This application claims the benefit of priority to U.S. Provisional Application No. 62/914,246, filed Oct. 11, 2019, the contents of which are incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2019, Scientific Games International, Inc.

FIELD

The present disclosure relates generally to gaming systems, apparatus, and methods and, more particularly, to a unique graphical user interface for presenting a plurality of selectable elements having differing properties associated therewith and allowing a player to select one or more of the elements using the interface.

BACKGROUND

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation.

Another significant technical challenge is to improve the operation of gaming apparatus and games played thereon by increasing processing speed and efficiency of usage of processing and/or memory resources. To make games more entertaining and exciting, they often offer the complexities of advanced graphics and special effects, multiple bonus features with different game formats, and multiple random outcome determinations per feature. The game formats may, for example, include picking games, reel spins, wheel spins, and other arcade-style play mechanics. Inefficiencies in processor execution of the game software can slow down play of the game and prevent a player from playing the game at their desired pace.

As the industry matures, the creativity and ingenuity required to improve such operation of gaming apparatus and games grows accordingly.

SUMMARY

According to one aspect of the present invention, a gaming system is disclosed that includes a regulated gaming machine primarily dedicated to playing at least one casino wagering game. The gaming system further includes one or more electronic input devices, one or more electronic display devices, and game-logic circuitry. The game-logic circuitry is configured to detect a physical item associated with a monetary value that establishes a credit balance and thereafter initiate the casino wagering game in response to an input indicative of a wager covered by the credit balance. The game-logic circuitry is further configured to direct at least one of the one or more display devices to display a graphical-user interface that includes a plurality of selectable elements, where each of the plurality of selectable elements is associated with at least one game outcome. The game-logic circuitry is further configured to detect an initial selection of a first one of the plurality of selectable elements and designate the first one of the plurality of selectable elements as an active selection. The game-logic circuitry is also configured to concurrently provide the abilities to elect to: (1) exchange the first one of the plurality of selectable elements with a another one of the plurality of selectable elements, the another one being designated—and the first one losing the designation of—the active selection upon the exchange, (2) eliminate one or more of the plurality of selectable elements that are not the active selection by revealing a game outcome associated with the eliminated selectable element, the game outcome associated with the eliminated selectable being unavailable for the remainder of the wagering game, and (3) reveal and accept the game outcome associated with the one of the plurality of selectable element that is currently designated as the active selection. The gaming system may be incorporated into a single, freestanding gaming machine.

In accordance with another aspect of the present invention, a casino gaming machine that is primarily dedicated to playing at least one casino wagering game is disclosed. The gaming machine includes an electronic display device and one or more electronic input devices. The gaming machine is adapted to detect the presence of a physical item associated with a monetary value that establishes a credit balance, initiate the casino wagering game in response to an input indicative of a wager covered by the credit balance, and display a plurality of selectable elements, each of the plurality of selectable elements being associated with at least one game outcome. The gaming machine is further adapted to detect an initial designation of a first one of the plurality of selectable elements as an active element, where the first one of the plurality of selectable elements is associated with a first game outcome, and where after the initial designation, the first one of the plurality of selectable elements is coupled to the active element and the active element is associated with the first game outcome. The gaming machine is further adapted to concurrently provide the abilities to: (1) reassign the active element by designating as the active element a second one of the plurality of selectable elements having a second game outcome associated therewith, the reassignment resulting in the active element becoming decoupled from the first one of the plurality of selectable elements and the first game outcome, the reassignment further resulting in the active element becoming coupled to the second one of the plurality of selectable elements and the active element being associated with the second game outcome, (2) eliminate one or more of the plurality of selectable elements that are not the active element by revealing a game outcome associated with the eliminated selectable element, the game outcome associated with the eliminated selectable being unavailable for the remainder of the wagering game, and (3) reveal and accept the game outcome associated with the active element.

In accordance with another aspect of the present invention, a computer-implemented method in a gaming system primarily dedicated to playing at least one casino wagering game is disclosed. The method includes detecting a physical item associated with a monetary value that establishes a credit balance and initiating the casino wagering game in response to an input indicative of a wager covered by the credit balance. The method further includes displaying a plurality of selectable elements, each of the plurality of selectable elements being associated with at least one game outcome. The method further includes detecting an initial designation of a first one of the plurality of selectable elements as an active element, the first one of the plurality of selectable elements being associated with a first game outcome, wherein after the initial designation the first one of the plurality of selectable elements is coupled to the active element and the active element is associated with the first game outcome. The method further includes concurrently providing the abilities to: (1) reassign the active element by designating as the active element a second one of the plurality of selectable elements having a second game outcome associated therewith, the reassignment resulting in the active element being decoupled from the first one of the plurality of selectable elements and the first game outcome, the reassignment further resulting in the active element being coupled to the second one of the plurality of selectable elements and the active element being associated with the second game outcome, (2) eliminate one or more of the plurality of selectable elements that are not the active element by revealing a game outcome associated with the eliminated selectable element, the game outcome associated with the eliminated selectable being unavailable for the remainder of the wagering game, and (3) reveal and accept the game outcome associated with the active element.

According to still another aspect of the present invention, a computer readable medium is disclosed that is encoded with instructions for directing a gaming system to perform the above-described method.

Additional aspects of the invention will be apparent to those of ordinary skill in the art in view of the detailed description of various embodiments, which is made with reference to the drawings, a brief description of which is provided below.

Figure 1:
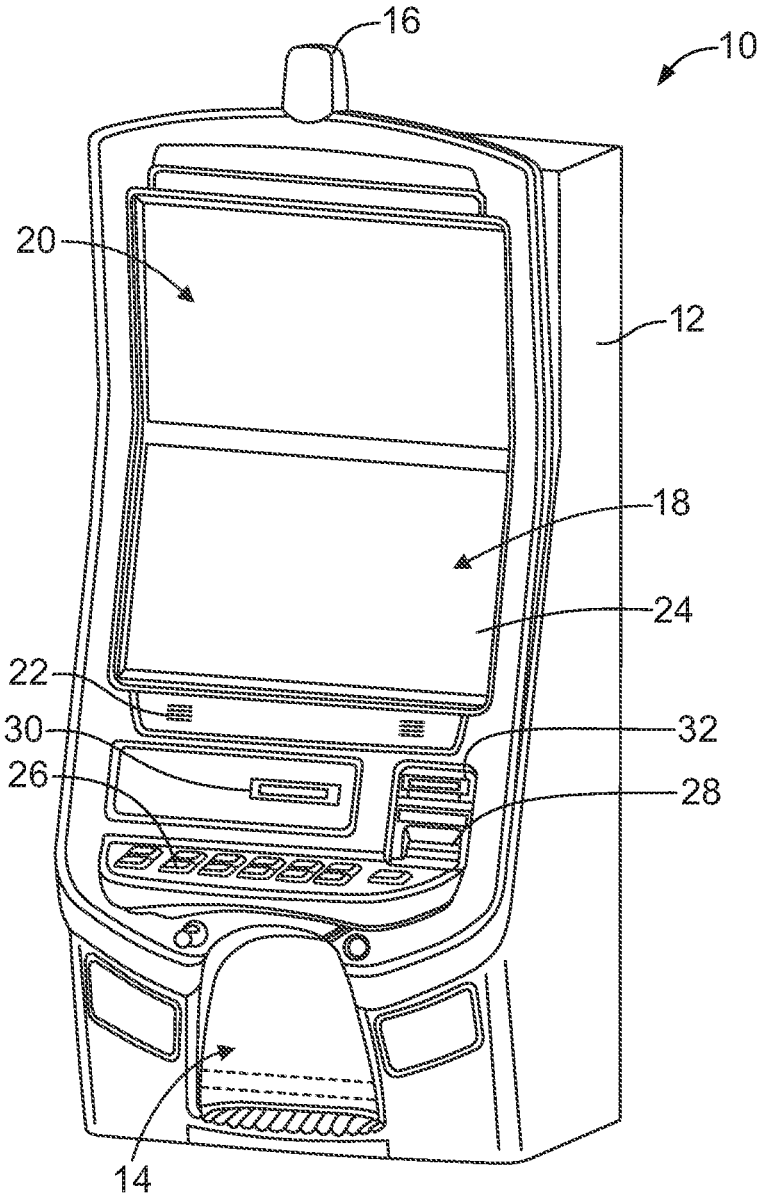
FIG. 1 is a perspective view of a free-standing gaming machine according to one or more embodiments of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation.

For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the credit meter 84 (see FIG. 3). The physical item may, for example, be currency bills, coins, tickets, vouchers, coupons, cards, or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the credit meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
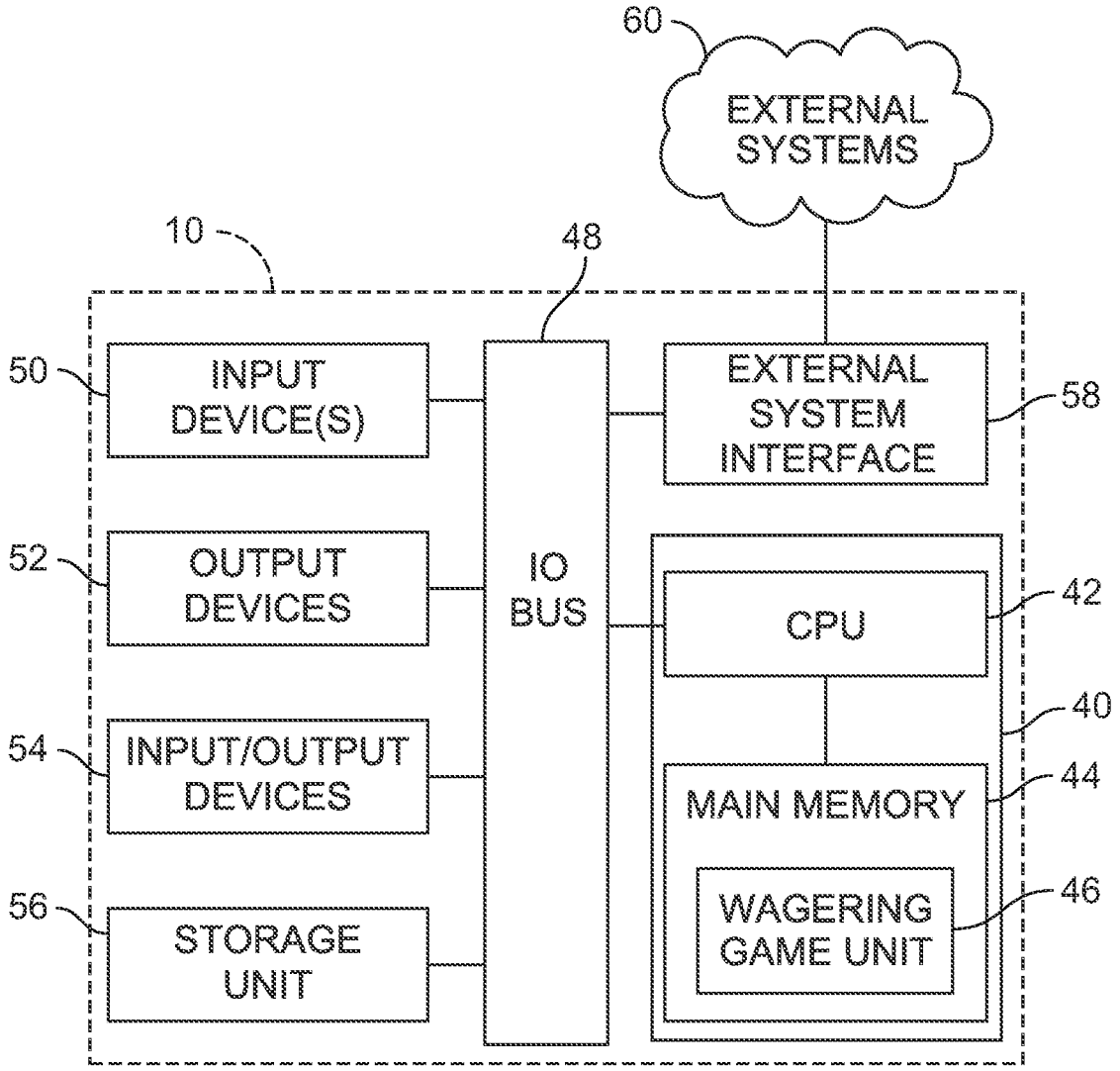
FIG. 2 is a schematic view of a gaming system according to one or more embodiments of the present disclosure.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
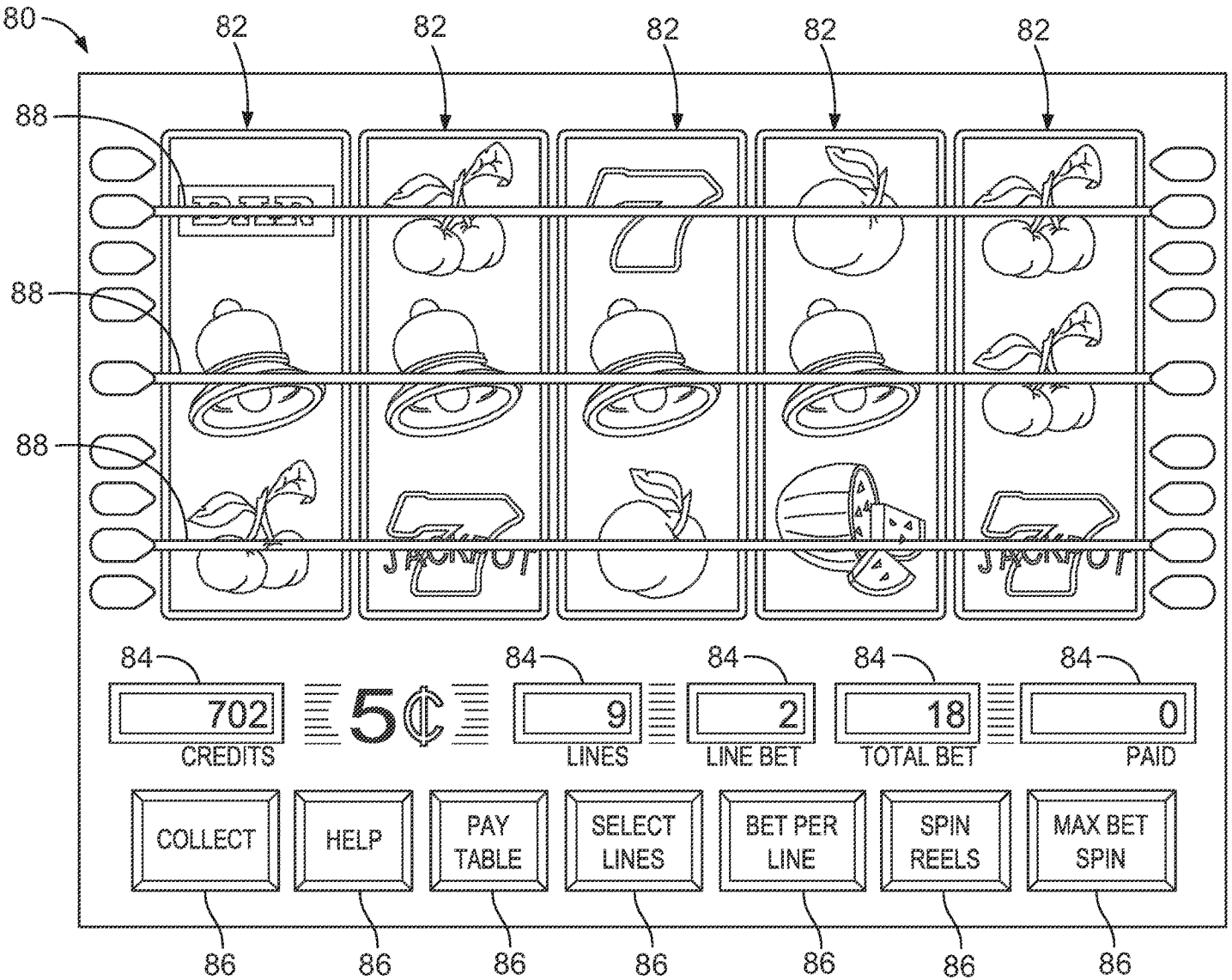
FIG. 3 is an image of an exemplary basic-game screen of a wagering game displayed on a gaming machine, according to one or more embodiments of the present disclosure.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by or deducted from the credit balance on the credit meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4:
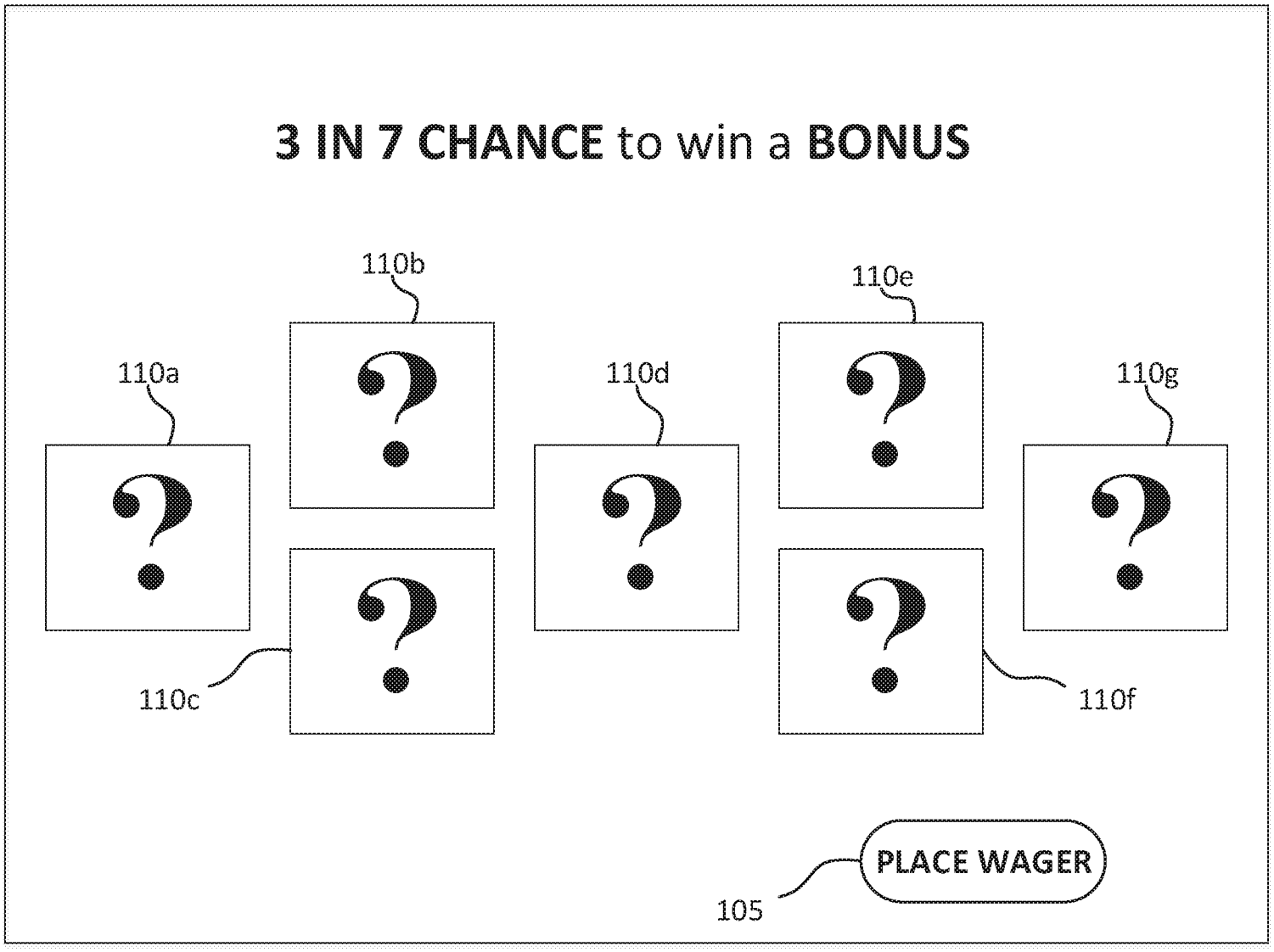
FIG. 4 is an image of a graphical-user interface presenting a wagering game on a gaming machine, according to one or more embodiments of the present disclosure.

Referring now to FIG. 4, a graphical-user interface 100 is illustrated according to one embodiment of the present invention. According to some embodiments, the graphical-user interface 100 may be used to display a wagering game to a player on the primary display 18 of the gaming machine 10. In these embodiments, a player begins play by establishing a credit balance, for example, by inserting a physical item associated with a monetary value into the bill/ticket acceptor 28. Once a credit balance has been established, the player may select a place-wager button 105, which in one embodiment is selectable using the touch screen 24 or through any other input devices 50 adapted to receive such an input from the player. In the illustrated embodiment of the present invention, upon a player's placement of a wager, a plurality of selectable elements 110 are provided. Each selectable element is associated with one or more game outcomes for the wagering game that are hidden from the player until a reveal event as described herein. In the illustrated embodiment, the selectable elements 110 are represented by the seven selectable elements 110*a-g* that are provided on the graphical-user interface 100, with three of the seven selectable elements 110*a-g* masking an award outcome for the player and four of the seven selectable elements masking a non-award outcome.

Figure 5:
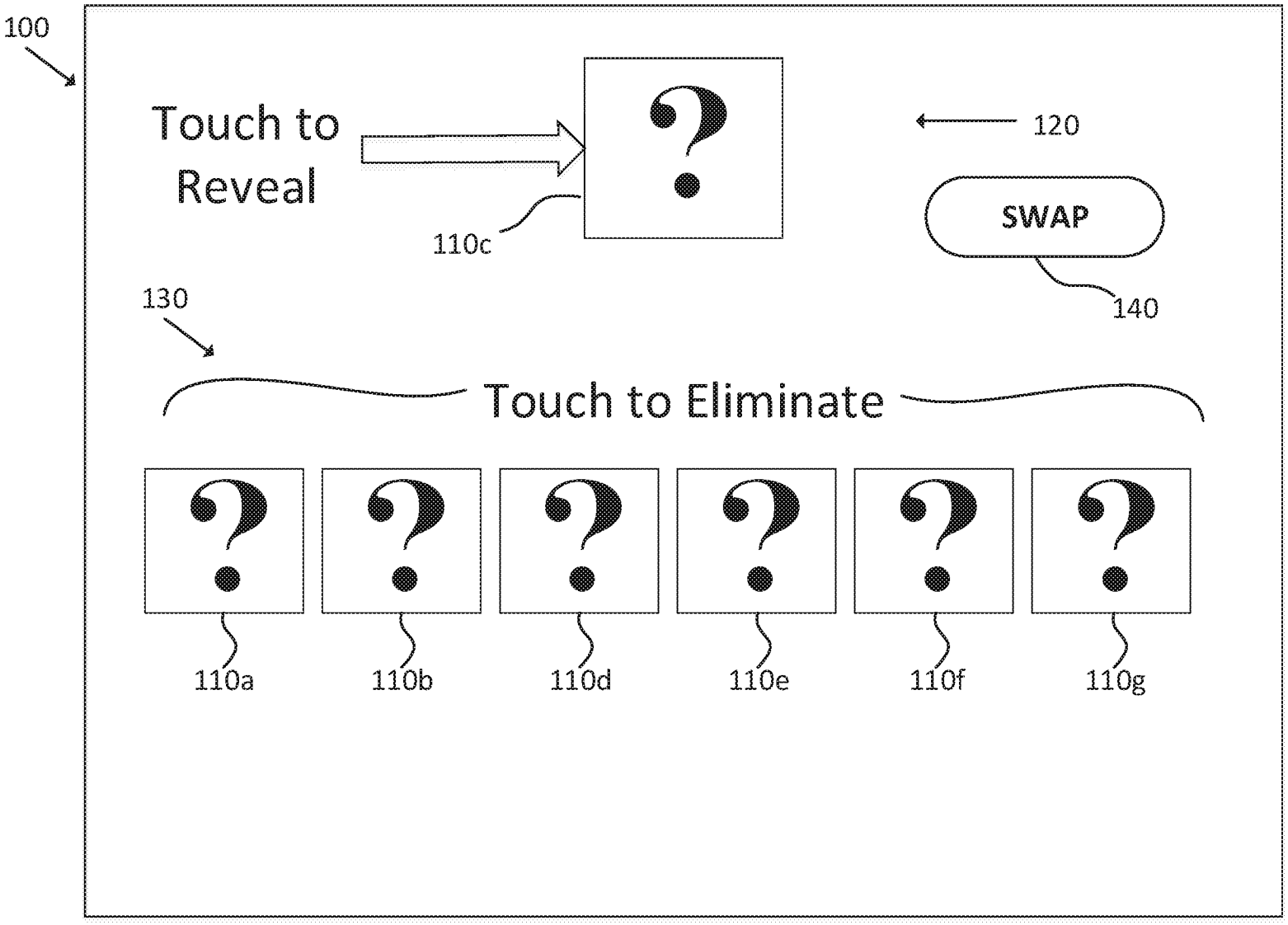
FIG. 5 is an image of a graphical-user interface presenting a wagering game on a gaming machine, according to one or more embodiments of the present disclosure.

Turning now to FIG. 5, upon selection of one of the selectable elements 110*a-g* by the player, the chosen selectable element 110 is moved into an active-selection area 120. In the illustrated embodiment, the player has initially chosen selectable element 110*c* from the graphical-user interface 100. Once chosen by the player, the selectable element 110*c* moves into the active-selection area 120 with the remaining selectable elements 110*a*, 110*b*, 110*d*, 110*e*, 110*f*, 110*g* being positioned in an elimination area 130. While within the active-selection area 120, the selectable element 110*c* is considered to be the active element for the wagering game. Over the course of the wagering game, although the active element may become associated with a different one of the selectable elements 110*a-g* (as will be discussed further below), the game outcome that is associated with the active element at the conclusion of the wagering game will be the game outcome received by the player.

Once the selectable element 110*c* has been placed in the active-selection area 120 and designated as the active element, the player may at any point thereafter choose to receive the game outcome that is associated with the selectable element 110*c* (so long as the selectable element 110*c* remains designated as the active element). To collect the game outcome for selectable element 110*c* in the active-selection area 120, the player may again choose the selectable element 110*c* while it is within the active-selection area 120—and thus, designated as the active element—by utilizing the touch screen 24 or through any other input devices 50 adapted to receive such an input from the player. In some embodiments, once the player has chosen to accept the game outcome associated with selectable element 110*c*, the game outcomes associated with the remaining selectable elements 110*a*, 110*b*, 110*d*, 110*e*, 110*f*, 110*g* are no longer available to the player.

As an alternative to the player choosing to accept the game outcome associated with selectable element 110*c*, the player may choose instead to: (1) reveal one or more of the game outcomes associated with the remaining selectable elements 110*a*, 110*b*, 110*d*, 110*e*, 110*f*, 110*g* located in the elimination area 130; or (2) exchange the selectable element 110*c* located in the active-selection area 120 with one of the selectable elements 110*a*, 110*b*, 110*d*, 110*e*, 110*f*, 110*g* located in the elimination area 130 using an exchange-element button 140. In one embodiment of the present invention, the player is allowed to make any number of exchanges of selectable elements 110 over the course of the wagering game. According to another embodiment of the invention, once a selectable element 110 has been exchanged from the active-selection area 120 to the elimination area 130, it can no longer return to the active-selection area 120 and the player loses any award outcome associated with that selectable element 110.

In the illustrated example, the player will decide to reveal two of the selectable elements 110*b*, 110*f* located in the elimination area 130 while selectable element 110*c* remains in the active-selection area 120. To reveal the selectable elements 110*b* and 110*f*, the player may utilize the touch screen 24 or another input device 50 adapted to receive such an input from the player. Once the player selects a selectable element 110 in the elimination area 130, the game outcome associated with that selectable element 110 is revealed to the player but the selectable element 110 becomes an eliminated element 115 and the player loses any award outcome that was associated with the selectable elements 110 turned eliminated elements 115.

Figure 6:
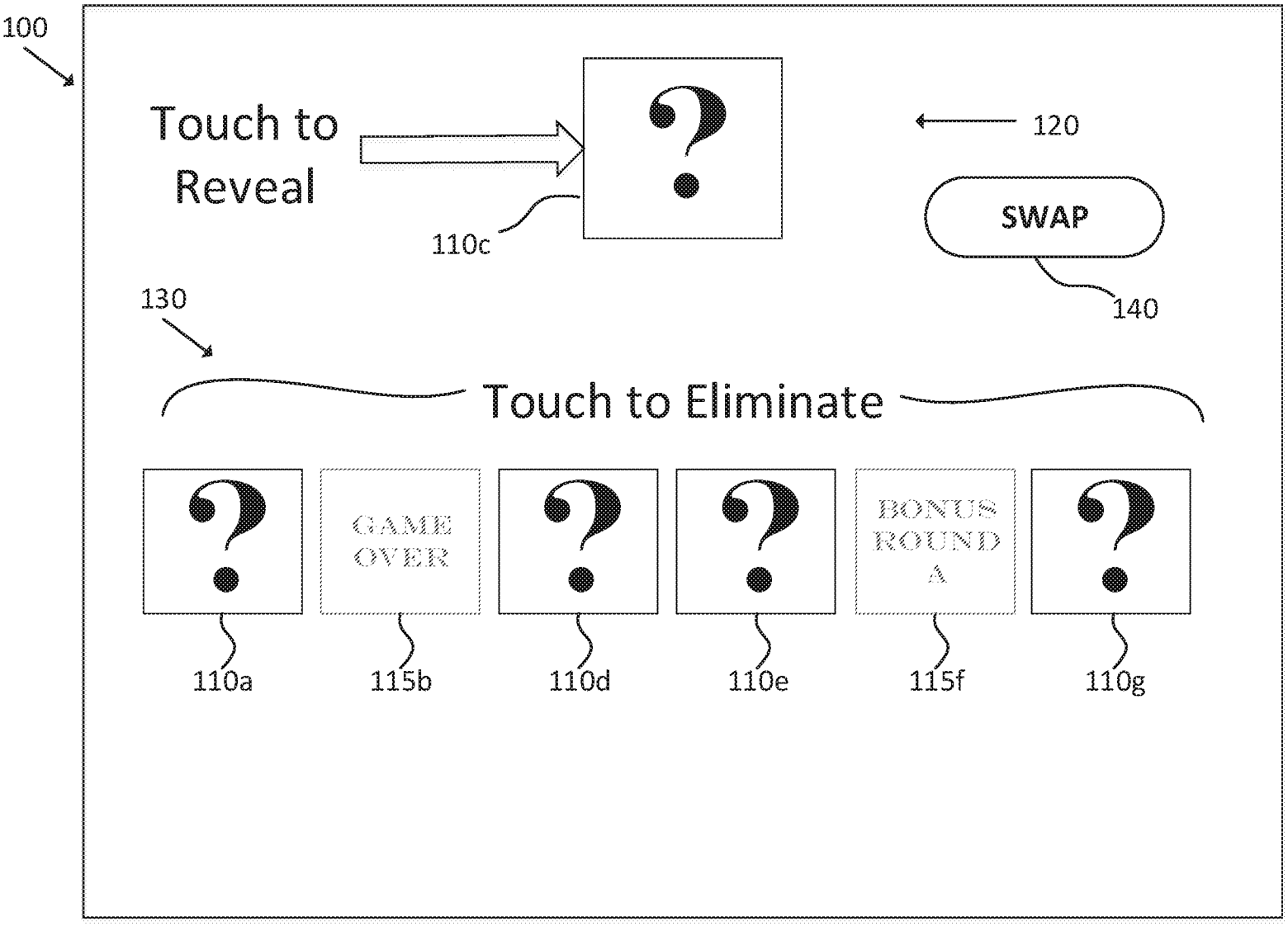
FIG. 6 is an image of a graphical-user interface presenting a wagering game on a gaming machine, according to one or more embodiments of the present disclosure.

As illustrated in FIG. 6, the graphical-user interface 100 shows that the player has previously chosen to reveal two of the selectable elements 110*b*, 110*f* (see FIG. 5). Upon the player's selection, the game outcomes associated with each of the selectable elements 110*b*, 110*f* are revealed to the player and the selectable elements 110*b*, 110*f* have been converted to eliminated elements 115*b*, 115*f*. In one embodiment of the present invention, the eliminated elements 115*b*, 115*f* remain displayed to the player in their selected position. In this instance, the eliminated element 115*b* (formerly selectable element 110*b*) was associated with a non-award outcome which would have terminated the player's wagering game had the element been selected within the active-selection area 120. The eliminated element 115*f* (formerly selectable element 110*f*) was associated with one of the award outcomes, in this case "Bonus Round A," which would have awarded the player a bonus event to play for an extended experience and the potential for additional non-monetary or monetary awards.

For purposes of simplicity, the selectable elements 110*a-g* are reciprocal with the eliminated element 115*a-g* and will be referred to in their singular state going forward. For example, the eliminated element 115*b* (formerly selectable element 110*b*) will be referred to simply as eliminated element 115*b* once it has transitioned from the selectable element 110*b* to the eliminated element 115*b*. It should be noted, however, that the game outcome associated with an eliminated element 115 in the illustrated embodiment would have been the game outcome for the wagering game had its reciprocal selectable element 110 been moved into the active-selection area 110, thus being designated as the active selection at the time it was elected to be revealed.

After revealing the game outcomes associated with eliminated elements 115*b*, 115*f*, the wagering game continues. As discussed above, at any point during the wagering game the player may elect to exchange their previously chosen selectable element 110 located in the active-selection area 120 for any of the remaining selectable elements 110 located in the elimination area 130. To perform an exchange of the selectable elements 110, the player selects the exchange-element button 140 and then chooses one of the remaining selectable elements 110 from the elimination area 130 using the touch screen 24 or any other input device 50 adapted to receive such input. In the illustrated embodiment, the player continues to have the option to exchange the selectable element 110*c* for any of the remaining selectable elements 110*a*, 110*d*, 110*e*, 110*g* located in the elimination area 130. To actuate the exchange, the player chooses the exchange-element button 140, which may cause a prompt to appear on the graphical-user interface 100 asking the player to select one of the remaining selectable elements 110 located in the elimination area 130. Upon choosing one of the remaining selectable elements 110 from the elimination area 130, the newly chosen selectable element 110 receives the active-element designation and the previously chosen selectable element 110 loses the designation of active element.

Figure 7:
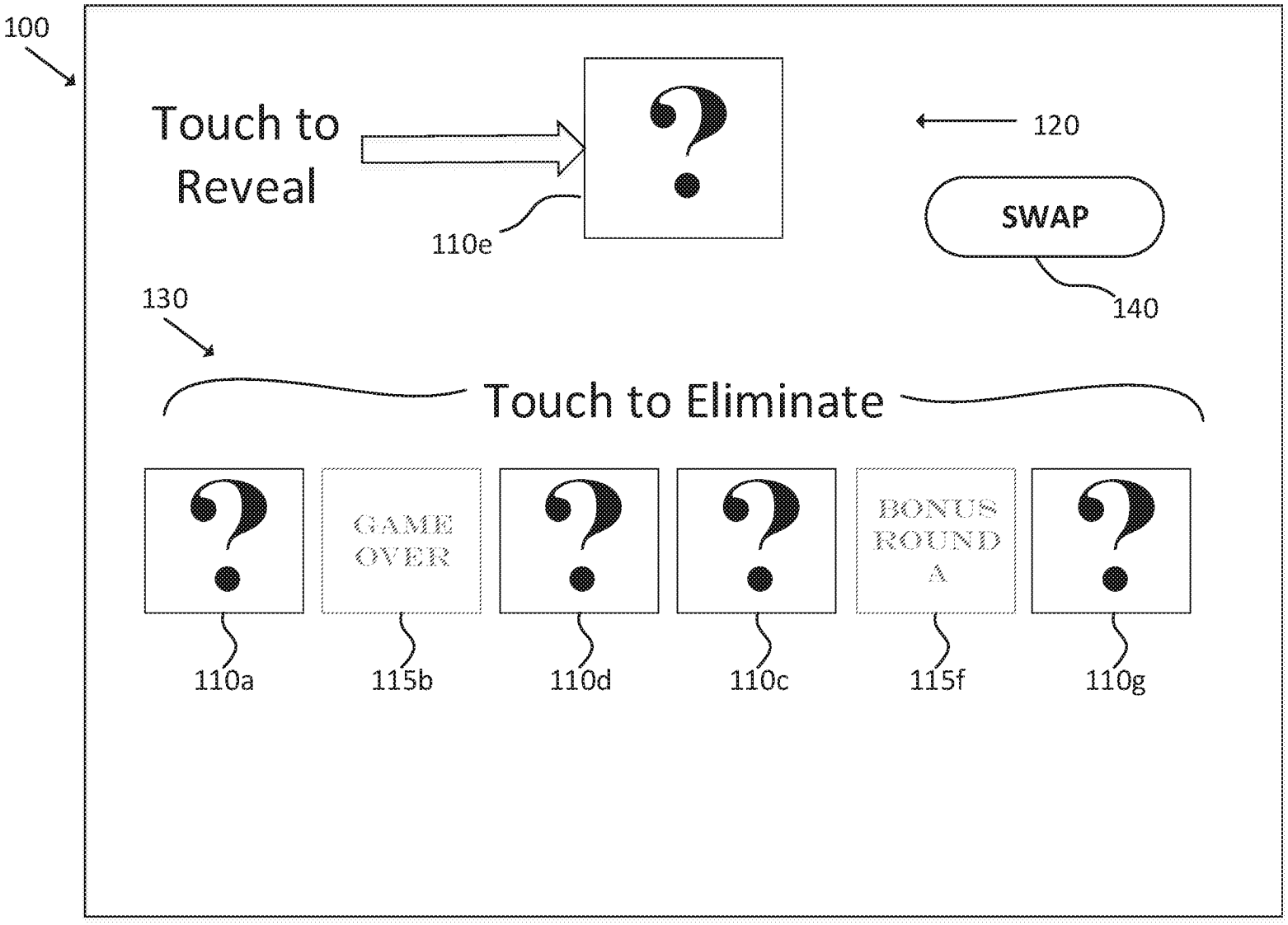
FIG. 7 is an image of a graphical-user interface presenting a wagering game on a gaming machine, according to one or more embodiments of the present disclosure.

As illustrated in FIG. 7, the player has decided to exchange their initially chosen selectable element 110*c* for another of the selectable elements 110*e*. As such, the selectable element 110*e* is moved from the elimination area 130 into the active-selection area 120 and the selectable element 110*c* is removed from the active-selection area 120 and placed in the elimination area 130 to replace selectable element 110*e*. In the illustrated embodiment, the selectable element 110*c* and its associated game outcome remains available to the player even after it has lost its designation as the active element (though it would have to be subsequently chosen redesignated as the active element for its associated game outcome to be the final outcome for the wagering game). In other embodiments, however, upon losing the active-element designation and being moved from the active-selection area 120 into the elimination area 130, the game outcome associated with the selectable element 110 may be automatically revealed to the player and the selectable element 110 would be converted to an eliminated element 115 and any associated award outcome would be lost by the player.

Figure 8:
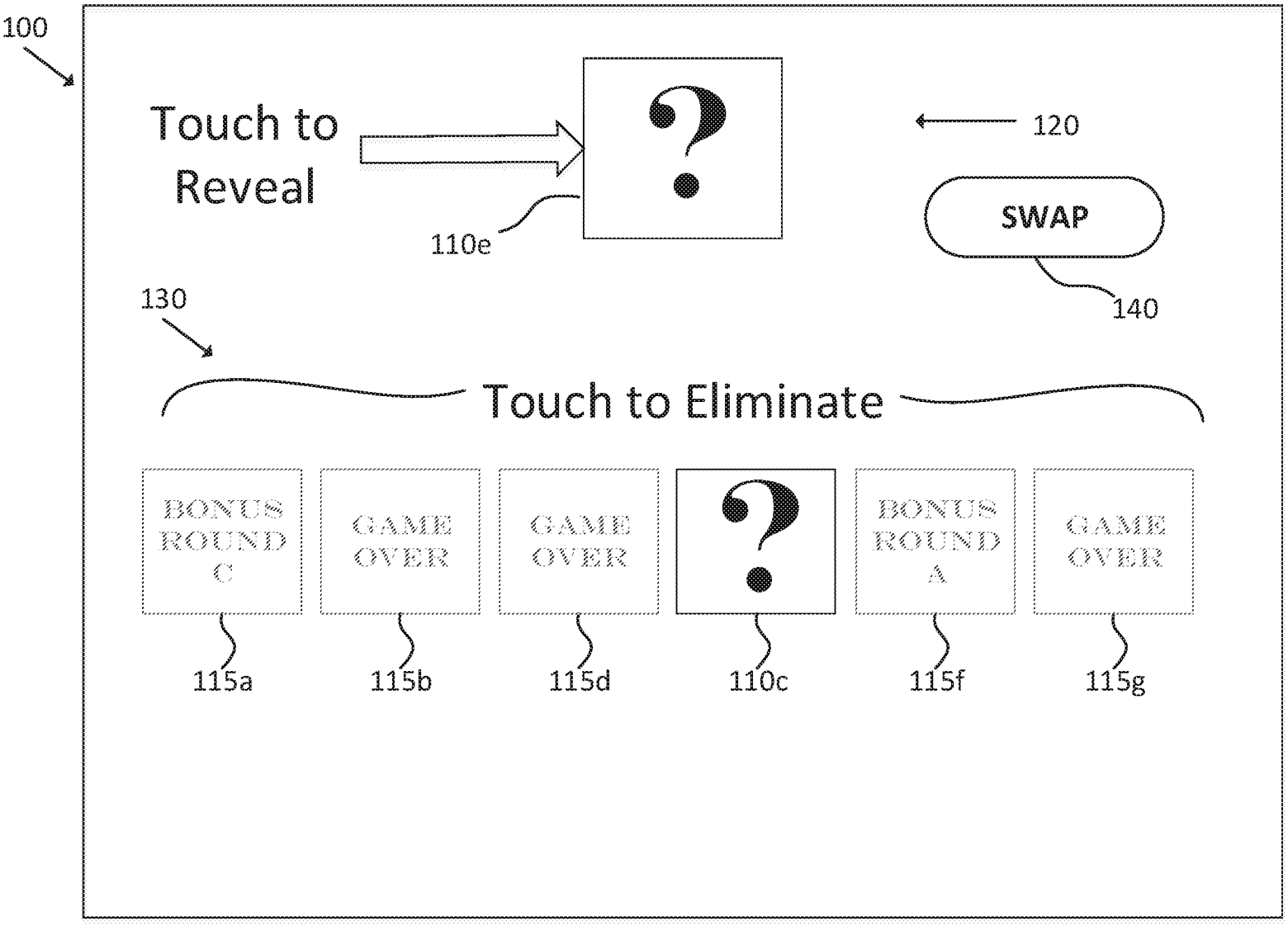
FIG. 8 is an image of a graphical-user interface presenting a wagering game on a gaming machine, according to one or more embodiments of the present disclosure.

The wagering game continues until the player elects to reveal the selectable element 110 located in the active-selection area 120 (e.g., the active element) or until all of the remaining selectable elements 110 have been converted into eliminated elements 115 in the elimination area 130. As shown in FIG. 8, the player has converted three more selectable elements 110*a*, 110*d*, 110*g* to eliminated elements 115*a*, 115*d*, and 115*g*. The player has revealed one more of the award outcomes ("Bonus Round C") and two additional non-award outcomes. In the illustrated embodiment, the player currently has two remaining selectable elements 110*c*, 110*e* available, one of which being associated with the lone remaining award outcome and the other being a wager-game-terminating, non-award outcome. In the event the player does not again utilize the exchange-elements button 140, the game outcome associated with selectable element 110*e* will be provided to the player and the game outcome associated with selectable element 110*c* will be revealed and lost as selectable element 110*c* is converted to an eliminated element 115. At this stage of game play, the player can decide to receive the game outcome associated with the selectable element 110*e* by selecting either the selectable element 110*e* in the active-selection area 120 or by selecting to eliminate the lone remaining selectable element 110*c* in the elimination area 130.

If the game outcome associated with the selectable element 110 the player ultimately elects to receive during the wagering game is a non-award outcome, the wagering game terminates and the graphical-user interface 100 resets (see, e.g., FIG. 4) to await the receipt of another wager to play another instance of the wagering game. Alternatively, if the game outcome associated with the selectable element 110 the player ultimately elects to receive during the wagering game is an award outcome, the player is provided that award. Award outcomes may be any type of positive outcome for the player such as the awarding of: credits or another monetary prize; a bonus event where monetary or non-monetary prizes may be won; another round of the above-described wagering game with even greater award outcomes; or any other desirable award.

Figure 9:
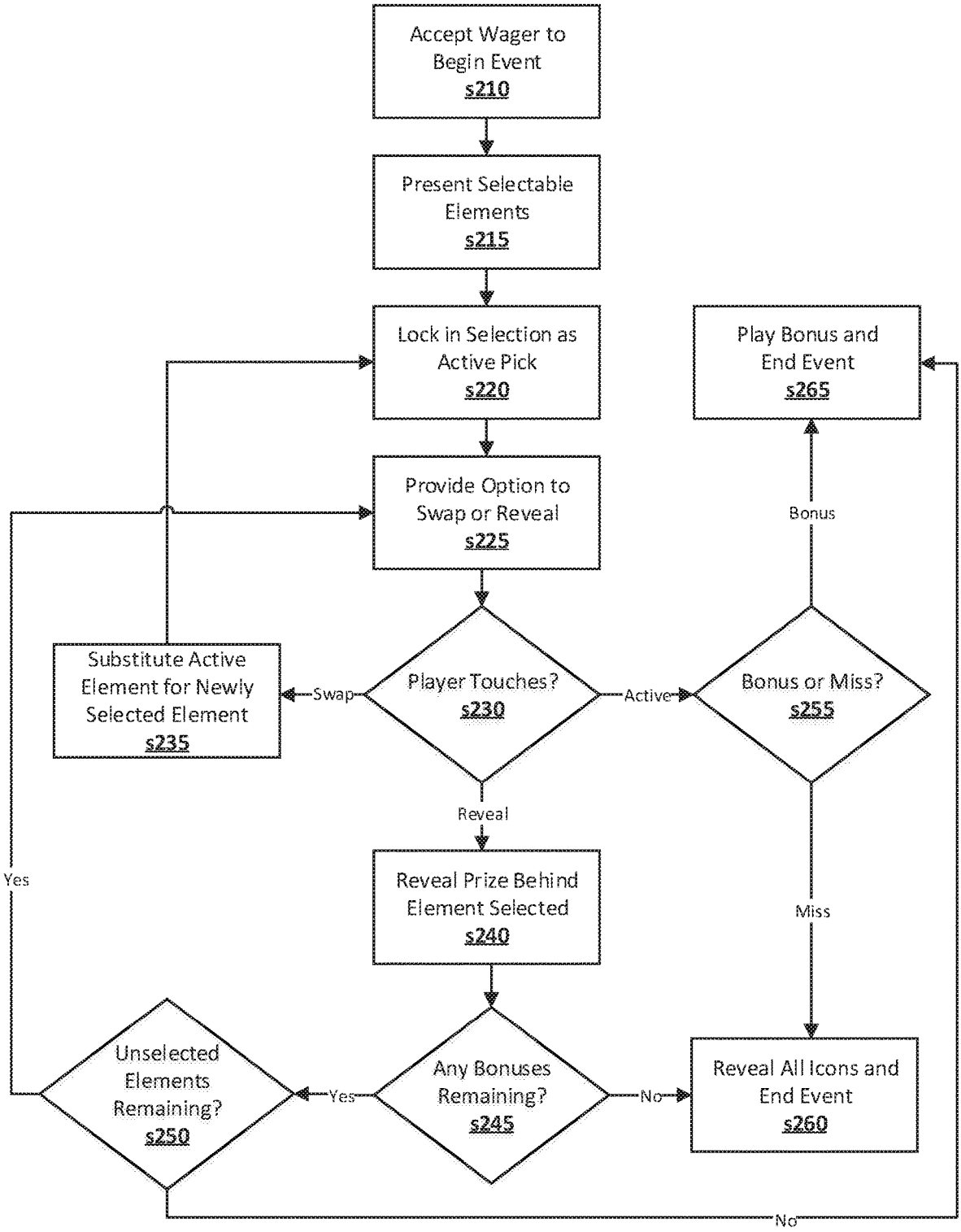
FIG. 9 is a flowchart for an algorithm that corresponds to instructions executed by a controller in accord with at least some aspects of the disclosed concepts.

FIG. 9, described by way of example above, represents one algorithm that corresponds to at least some instructions stored and executed by the game-logic circuitry 40 in FIG. 2 to perform the above described functions associated with the disclosed concepts. A player initiates play of the wagering game, at step s210, by any conventional method (e.g., inserting coins or cash, inserting a ticket with a monetary value, transferring funds electronically, using a preexisting credit balance on the gaming machine 10, etc.). Once the wagering game has been initiated through the acceptance of a wager at step s210, the game-logic circuitry 40 causes a plurality of selectable elements 110 to be displayed on the graphical-user interface 100 at step s215. Thereafter, a player chooses which of the selectable elements 110 will become the active element and move into the active-selection area 120 at step s220. Additionally at step s220, after a selectable element 110 has been placed and locked in the active-selection area 120 as the active element, any remaining selectable elements 110 are moved into the elimination area 130. At this stage of the wagering game, the game-logic circuitry 40 concurrently provides the player with the options, at step s225, to: (1) exchange the current active element with one of the selectable elements 110 located within the elimination area 130; (2) eliminate one of the selectable elements 110 within the elimination area 130; or (3) collect the game outcome associated with the active element (i.e., the selectable element 110 designated within the active-selection area 120. The player indicates their choice of one of the three options based on where the player interacts with the graphical-user interface 100 (e.g., by utilizing the touch screen 24 or another one of the input devices 50).

If the player decides to exchange the active element, the player may select the exchange-element button 140 located on the graphical-user interface 100. When the player selects the exchange-element button 140, a determination is made, at decision box s230, that the player wishes to exchange selectable elements 110 and the player is prompted to choose one of the remaining selectable elements 110 in the elimination area 130 to replace the selectable element 110 in the active-selection area 120. Once the player has selected one of the remaining selectable elements 110 from the elimination area 130, the newly chosen selectable element 110 is designated as the active element and substituted, at step s235, for the selectable element 110 previous residing in the active-selection area 120. After the substitution of selectable elements 110 at step s235, the game-logic circuitry 40 locks the newly chosen selectable element 110 into the active-selection area 120 at step 220.

Alternatively, at decision box s230, the game-logic circuitry 40 may determine that the player has decided to reveal the active element. To communicate the player's choice to the game-logic circuitry 40 the player may again select the selectable element 110 in the active-selection area 120 using the touch screen 24 or another of the input devices 50. Alternatively, or additionally, a "reveal outcome" button may be provided that the player could actuate. In some embodiments, the game-logic circuitry 40 can provide the player with a prompt displayed on the graphical-user interface 100 asking the player to confirm their choice to reveal the active element and accept the game outcome currently associated therewith as the game outcome for the wagering game. If the game-logic circuitry 40 determines, at decision box s230, that the player has decided to reveal the active element, a determination is made, at decision box s255, whether the active element is associated with an award outcome (e.g., a bonus game) or a non-award outcome (e.g., a game-over icon).

If the game-logic circuitry 40 determines, at decision box s255, that a non-award outcome is associated with the active element, the remaining selectable elements 110 are revealed to the player (at least one of which will display an award outcome that was associated therewith) and the wagering game ends at step s260. Alternatively, if the game-logic circuitry 40 determines, at decision box s255, that an award outcome is associated with the active element, that award outcome is provided to the player. In some embodiments where the award outcome is a bonus event, the game-logic circuitry 40 initiates the bonus event, provides any awards from the bonus event to the player, and thereafter ends both the bonus event and the wagering game at step s265. In some embodiments, where the award outcome is a credit award, the credits are immediately awarded to the player and the wagering game is ended. In still other embodiments, when an award outcome is a bonus event, at the conclusion of the bonus event the player may be returned to the wagering game to select another of the remaining selectable elements 110 (or the selectable elements 110 may all be reset and the wagering game played anew) and the wagering game will continue to play until a non-award outcome is selected and revealed by the player at decision box s255.

Referring again to decision box s230, the game-logic circuitry 40 may determine that the player has decided to eliminate one of the selectable elements 110 located in the elimination area 130. To effectuate the elimination according to one embodiment, the player chooses one of the selectable elements 110 from the elimination area 130 to be revealed to the player at step s240. In another embodiment, the player may not directly decide which of the selectable elements 110 in the elimination area 130 will be remove but rather the graphical-user interface 100 may include a "remove element" button that, when actuated, randomly selects one of the selectable elements 110 from the elimination area 130 to be revealed to the player at step s240. Regardless of the method for choosing which selectable element 110 from the elimination area 130 to remove, once that selectable element 110 has been chosen, the game outcome associated with that selectable element 110 is revealed to the player at step s240. The revealed selectable element 110 may be removed from the wagering game entirely or remain displayed within the graphical-user interface 100 as an eliminated element 115.

After the selectable element 110 is revealed at step s240, the game-logic circuitry 40 determines, at decision box s245, whether any award outcomes still remain available to the player (i.e., is there at least one remaining, unrevealed selectable element 110 that has an award outcome associated with it). If, at decision box s245, the game-logic circuitry 40 determines that there are no additional, unrevealed award outcomes, the remaining selectable elements 110 (including the active element) are revealed to the player (all of which showing that they had a non-award outcome associated therewith) and the wagering game ends at step s260. Alternatively, if a determination is made, at decision box s245, that at least one award outcome remains unrevealed, the game-logic circuitry 40 determines, at decision box s250, whether there are any remaining unrevealed selectable elements 110 in the elimination area 130.

If no selectable elements 110 remain in the elimination area 130, the game-logic circuitry 40 determines, at decision box s250, that the only remaining selectable element 110 (the active element) is associated with an award outcome and, in some of the embodiments where the award outcome is a bonus event, the game-logic circuitry 40 initiates the bonus event, provides any awards from the bonus event to the player, and thereafter ends both the bonus event and the wagering game at step s265. Alternatively, if the determination is made, at decision box s250, that the elimination area 130 includes at least one remaining selectable element 110, the game-logic circuitry 40 once again provides the player with the option, at step s225, to: (1) exchange the active element for a different selectable element 110; (2) eliminate one of the selectable elements 110 within the elimination area 130; or (3) to collect the game outcome associated with the active element.

As described in FIG. 9, the wagering game continues until one of three ultimate conclusions has been reached. The wagering game concludes when either (1) the player has chosen to accept the game outcome associated with the active element, (2) the player has eliminated all of the possible award outcomes associated with the selectable elements 110, or (3) the player has eliminated all of the selectable elements 110 from the elimination area 130. It should be noted that at the conclusion of the wagering game, any unrevealed selectable element 110 (including the active element) may have its associated game outcome displayed to the player so as to show the player what the potential award outcomes were and where they were located on the graphical-user interface 100.

The bonus event described above may be any suitable event that is adapted to provide the player with the potential for a future prize, whether monetary, non-monetary, or entertainment. For example, the bonus event of the present invention may be a free-spin event, a wheel spin, a picking game, an entry in a keno or lottery-type drawing, a direct credit prize, or any other desirable event. The award outcomes may all award the same bonus event or the bonus events may be variable between the one or more selectable elements 110 that are associated with an award outcome.

The above-illustrated embodiment has been described with respect to an elimination area and an active-selection area for convenience. These areas are not required to effectuate the invention and, in many embodiments, these areas are not present. In some of these embodiments, the active element is highlighted or otherwise visually distinguished from the selectable elements, but is not otherwise moved to a particular area on the graphical-user interface.

In the above-described embodiment, the wagering game included a single active element but in alternative embodiments, two, three, or more active elements may be designated such that when the wagering game provides the player with multiple game outcomes at the conclusion of the wagering game. In some embodiments with multiple active elements, one of the active elements may be designated as a "super element" and if an award outcome is associated with the super element at the conclusion of the wagering game, that award outcome is enhanced relative to its value were it to be designated as the standard active element.

The payback percentage for a wagering game is calculated based on the probability of discreet events occurring within the wagering game. Each of these events has a probability of occurring and an award (or no award) associated with its occurrence. The combination of the probability and award value for a particular event is known as the expected value for that event. By summing all of the expected values for all of the events within the wagering game, the overall expected value for the wagering game can be determined. This overall expected value equals the theoretical payback percentage for the wagering game. According to the illustrated embodiment, as well as other embodiments of the present invention, the expected value for the wagering game remains constant no matter which selectable element the player designates as the active element, how may selectable elements the player eliminates prior to revealing the active element, or the number of selectable elements the player designates as the active element over the course of the game.

The above-illustrated wagering game has been described so as to allow a player to control their own wagering game experience, without being able to alter the expected value for the wagering game itself. The above-illustrated wagering game gives the player the ability to create near-miss opportunities and choose to extend the amount time that passes between the wager and the conclusion of the wagering game—all without allowing the player to alter the expected value for the wagering game. In other embodiments, however, the game rules can be altered to allow the expected value to be positively or negatively impacted. For example, if the game-logic circuitry included instructions that caused it to eliminate selectable elements from the elimination area in a non-random fashion, it would introduce a player-skill component into the game where the player's strategy over the course of the wagering game could directly increase or decrease the overall expected value for that instance of the wagering game.

While the above-described elimination mechanism has been detailed with respect to a player-selection mechanism, many types of elimination events can be utilized. For example, in some embodiments, a selectable element in the elimination area is revealed and eliminated after a predetermined amount of time has passed. In other embodiments, the selectable elements are moved onto an elimination wheel where each slice of the wheel includes one of the selectable elements. When an elimination is elected, the wheel spins and one of the slices is removed from the wheel. This process can continue for each elimination election until there are no remaining slices on the wheel and the active element (that is not part of the wheel) is then revealed.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A gaming system, comprising:

a regulated gaming machine primarily dedicated to playing at least one casino wagering game, the gaming machine including one or more electronic input devices;

one or more electronic display devices; and game-logic circuitry configured to:

detect, via at least one of the one or more electronic input devices, a physical item associated with a monetary value that establishes a credit balance;

initiate the casino wagering game in response to an input indicative of a wager covered by the credit balance;

direct at least one of the one or more display devices to display a graphical-user interface that includes a plurality of selectable elements, each of the plurality of selectable elements being associated with at least one game outcome;

detect, via at least one of the one or more electronic input devices, an initial selection of a first one of the plurality of selectable elements and designating the first one of the plurality of selectable elements as an active selection;

in response to the detection of the initial selection, concurrently providing, via the graphical-user interface, the abilities to elect to: (1) exchange the first one of the plurality of selectable elements with a another one of the plurality of selectable elements, the another one being designated—and the first one losing the designation of—the active selection upon the exchange, (2) eliminate one or more of the plurality of selectable elements that are not the active selection by revealing a game outcome associated with the eliminated selectable element, the game outcome associated with the eliminated selectable being unavailable for the remainder of the wagering game, and (3) reveal and accept the game outcome associated with the one of the plurality of selectable element that is currently designated as the active selection; and receive, via at least one of the one or more electronic input devices, a cashout input that initiates a payout from the credit balance.

2. The gaming system of claim 1, wherein the concurrently provided abilities remain available via the graphical-user interface until (1) a detection of the election to reveal and accept the game outcome associated with the designated active selection or (2) a determination that the last of the plurality of selected elements that is not the active selection has been eliminated.

3. The gaming system of claim 1, wherein the election to exchange the first one of the plurality of selectable elements with another of the selectable elements causes the first one of the plurality of selectable elements to be eliminated, and its associated game outcome revealed, the first one and its associated game outcome thereafter being unavailable for the remainder of the wagering game.

4. The gaming system of claim 1, wherein the game outcomes associated with a first plurality of the plurality of selectable elements are one or more award outcomes and the game outcomes associated with a second plurality of the plurality of selectable elements are non-award outcomes.

5. The gaming system of claim 4, wherein at least one of the award outcomes is a bonus event.

6. The gaming system of claim 1, wherein the game outcomes associated with the plurality of selectable elements are revealed on the graphical-user interface prior to the conclusion of the wagering game.

7. The gaming system of claim 1, wherein the expected value of the wagering game remains constant no matter how many elections are received and no matter which order the elections are received.

8. A casino gaming machine primarily dedicated to playing at least one casino wagering game, comprising:

an electronic display device;

one or more electronic input devices; and means for:

detecting, via at least one of the one or more electronic input devices, a physical item associated with a monetary value that establishes a credit balance;

initiating the casino wagering game in response to an input indicative of a wager covered by the credit balance;

displaying a plurality of selectable elements, each of the plurality of selectable elements being associated with at least one game outcome;

detecting an initial designation of a first one of the plurality of selectable elements as an active element, the first one of the plurality of selectable elements being associated with a first game outcome, wherein after the initial designation the first one of the plurality of selectable elements is coupled to the active element and the active element is associated with the first game outcome;

subsequent to detecting the initial designation, concurrently providing abilities to: (1) reassign the active element by designating as the active element a second one of the plurality of selectable elements having a second game outcome associated therewith, the reassignment resulting in the active element being decoupled from the first one of the plurality of selectable elements and the first game outcome, the reassignment further resulting in the active element being coupled to the second one of the plurality of selectable elements and the active element being associated with the second game outcome, (2) eliminate one or more of the plurality of selectable elements that are not the active element by revealing a game outcome associated with the eliminated selectable element, the game outcome associated with the eliminated selectable being unavailable for the remainder of the wagering game, and (3) reveal and accept the game outcome associated with the active element; and receiving, via at least one of the one or more electronic input devices, a cashout input that initiates a payout from the credit balance.

9. The casino gaming machine of claim 8, wherein the concurrently provided abilities remain available until (1) detecting an election to reveal and accept the game outcome associated with the active element or (2) determining that the last of the plurality of selected elements that is not the active selection has been eliminated.

10. The casino gaming machine of claim 8, with further means for:

eliminating the first one of the plurality of selectable elements when it is decoupled from the active element;

revealing the first game outcome when the first one of the plurality of selectable elements has been eliminated; and preventing the first game outcome from being thereafter being awarded during the wagering game.

11. The casino gaming machine of claim 8, wherein the game outcomes associated with a first plurality of the plurality of selectable elements are one or more award outcomes and the game outcomes associated with a second plurality of the plurality of selectable elements are non-award outcomes.

12. The casino gaming machine of claim 11, wherein at least one of the award outcomes is a bonus event.

13. The casino gaming machine of claim 8, with further means for revealing the game outcomes associated with the plurality of selectable elements prior to the conclusion of the wagering game.

14. The casino gaming machine of claim 8, wherein the expected value of the wagering game remains constant.

15. A method of operating a gaming system, the gaming system including game-logic circuitry and a gaming machine, the gaming machine primarily dedicated to playing at least one casino wagering game, the gaming machine including an electronic display device and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

displaying a plurality of selectable elements, each of the plurality of selectable elements being associated with at least one game outcome;

detecting an initial designation of a first one of the plurality of selectable elements as an active element, the first one of the plurality of selectable elements being associated with a first game outcome, wherein after the initial designation the first one of the plurality of selectable elements is coupled to the active element and the active element is associated with the first game outcome;

subsequent to detecting the initial designation, concurrently providing abilities to: (1) reassign the active element by designating as the active element a second one of the plurality of selectable elements having a second game outcome associated therewith, the reassignment resulting in the active element being decoupled from the first one of the plurality of selectable elements and the first game outcome, the reassignment further resulting in the active element being coupled to the second one of the plurality of selectable elements and the active element being associated with the second game outcome, (2) eliminate one or more of the plurality of selectable elements that are not the active element by revealing a game outcome associated with the eliminated selectable element, the game outcome associated with the eliminated selectable being unavailable for the remainder of the wagering game, and (3) reveal and accept the game outcome associated with the active element; and receiving, via at least one of the one or more electronic input devices, a cashout input that initiates a payout from the credit balance.

16. The method of claim 15, wherein the concurrently provided abilities remain available until (1) detecting an election to reveal and accept the game outcome associated with the active element or (2) determining that the last of the plurality of selected elements that is not the active selection has been eliminated.

17. The method of claim 15, further comprising:

eliminating the first one of the plurality of selectable elements when it is decoupled from the active element;

revealing the first game outcome when the first one of the plurality of selectable elements has been eliminated; and preventing the first game outcome from being thereafter being awarded during the wagering game.

18. The method of claim 15, wherein the game outcomes associated with a first plurality of the plurality of selectable elements are one or more award outcomes and the game outcomes associated with a second plurality of the plurality of selectable elements are non-award outcomes.

19. The method of claim 18, wherein at least one of the award outcomes is a bonus event.

20. The method of claim 15, further comprising revealing the game outcomes associated with the plurality of selectable elements prior to the conclusion of the wagering game.

* * * * *